US010519661B2

(12) United States Patent
Izumi et al.

(10) Patent No.: US 10,519,661 B2
(45) Date of Patent: Dec. 31, 2019

(54) METAL ROOFING MATERIAL

(71) Applicant: Nisshin Steel Co. Ltd., Tokyo (JP)

(72) Inventors: Keiji Izumi, Tokyo (JP); Yuugo Oota, Tokyo (JP); Tomoyuki Nagatsu, Tokyo (JP)

(73) Assignee: Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 16/311,361

(22) PCT Filed: Oct. 3, 2016

(86) PCT No.: PCT/JP2016/079341
§ 371 (c)(1),
(2) Date: Dec. 19, 2018

(87) PCT Pub. No.: WO2018/003132
PCT Pub. Date: Jan. 4, 2018

(65) Prior Publication Data

US 2019/0203473 A1 Jul. 4, 2019

(30) Foreign Application Priority Data

Jul. 1, 2016 (JP) ..... 2016-131399

(51) Int. Cl.
*E04D 1/28* (2006.01)
*E04D 1/18* (2006.01)

(52) U.S. Cl.
CPC *E04D 1/18* (2013.01); *E04D 1/28* (2013.01)

(58) Field of Classification Search
CPC ..... E04D 1/18; E04D 1/28; E04D 1/26
(Continued)

(56) References Cited

U.S. PATENT DOCUMENTS 5,884,446 A * 3/1999 Hageman ..... E04D 11/02 52/309.8
6,108,993 A * 8/2000 Hageman ..... E04D 13/1643 52/309.8

(Continued)

FOREIGN PATENT DOCUMENTS

JP H7-317226 12/1995
JP H10-183872 7/1998

(Continued)

OTHER PUBLICATIONS

English translation of the International Preliminary Report on Patentability, counterpart International Appl. No. PCT/JP2016/079341 (dated Jan. 10, 2019) (11 pages).

(Continued)

*Primary Examiner* — Brent W Herring
(74) *Attorney, Agent, or Firm* — Cook Alex Ltd.

(57) ABSTRACT

A metal roofing material according to the present invention comprises: a front substrate 2 having a body portion 20, the body portion 20 being comprised of a metal sheet and being formed into a box shape; a back substrate disposed on a back side of the front substrate 2 so as to cover an opening of the body portion 20; a core material filled between the body portion 20 and the back substrate, the metal roofing material being arranged side by side on a roof base together with other metal roofing materials, wherein at least one edge indicator 22 in the form of protrusion is provided at an edge portion of a top plate 20*a* of the body portion 20.

17 Claims, 7 Drawing Sheets

(58) Field of Classification Search
USPC ..... 52/105
See application file for complete search history.

(56) References Cited

U.S. PATENT DOCUMENTS

| | | | | |
|---|---|---|---|---|
| 7,475,516 | B2 * | 1/2009 | Jolitz | E04D 1/205 52/105 |
| 7,516,593 | B2 * | 4/2009 | Jolitz | E04D 1/205 52/105 |
| 7,882,677 | B2 * | 2/2011 | Jolitz | E04D 1/205 52/105 |
| 8,099,923 | B2 * | 1/2012 | Jolitz | E04D 1/205 52/105 |
| 2004/0148874 | A1 * | 8/2004 | Jolitz | E04D 1/205 52/105 |
| 2005/0144850 | A1 * | 7/2005 | Hageman | E04D 3/351 52/3 |
| 2006/0078035 | A1 * | 4/2006 | Beck | G01N 25/16 374/55 |
| 2009/0165402 | A1 * | 7/2009 | Jolitz | E04D 1/205 52/105 |
| 2010/0186312 | A1 * | 7/2010 | Jolitz | E04D 1/205 52/105 |
| 2015/0089885 | A1 * | 4/2015 | Wakebe | E04D 1/18 52/105 |
| 2018/0080228 | A1 | 3/2018 | Izumi et al. | |

FOREIGN PATENT DOCUMENTS

| | | |
|---|---|---|
| JP | 2000-186396 | 7/2000 |
| JP | 2001-271455 | 10/2001 |
| JP | 2003-096979 | 4/2003 |
| JP | 2004-052429 | 2/2004 |
| JP | 2013-108311 | 6/2013 |
| JP | 2015-071927 | 4/2015 |
| JP | 5864015 | 2/2016 |
| JP | 6410763 | 10/2018 |

OTHER PUBLICATIONS

International Search Report and Written Opinion, counterpart International App. No. PCT/JP2016/079341, with partial English translation (dated Nov. 22, 2016) (11 pages).

Notification of Reasons for Refusal, counterpart Japanese App. No. 2016-131399, with English translation (dated Jul. 24, 2018) (9 pages).

Decision to Grant a Patent, Japanese App. No. 2016-131399, with English translation (dated Aug. 28, 2018) (5 pages).

Extended European Search Report, counterpart EP App. No. 16907365 (dated Apr. 29, 2019) (6 pages).

* cited by examiner

METAL ROOFING MATERIAL

The present application is a U.S. National Stage of PCT International Patent Application No. PCT/JP2016/079341, filed Oct. 3, 2016, which claims priority to JP Application No. 2016-131399, filed Jul. 1, 2016, both of which are hereby incorporated herein by reference.

TECHNICAL FIELD

The present invention relates to a roofing material arranged side by side on a roofing base together with other roofing materials.

BACKGROUND ART

This type of roofing material conventionally used can include, for example, a structure as shown in Patent Document 1 as described below, or the like. That is, the conventional roofing material is a ceramics-based flat roofing material represented by a decorative slate for a house roof, and a cutout is formed at an end portion of the roofing material. When such a roofing material is arranged side by side on the roof base together with other roofing materials, the cutouts of the adjacent roofing materials are butted against each other, thereby aligning the roofing materials.

On the other hand, the present inventors have attempted implementing a metal roofing material as disclosed in Patent Document 2, i.e., a metal roofing material including a metal front substrate; a back substrate disposed on a back side of the front substrate; and a core material made of a foamed resin filled between the front substrate and the back substrate.

CITATION LIST

Patent Literatures

Patent Document 1: Japanese Patent Application Publication No. 2013-108311 A

Patent Document 2: Japanese Patent No. 5864015 B

SUMMARY OF INVENTION

Technical Problem

The ceramics-based roofing material has a simple structure, so that a cutout can easily be formed at an end portion of the roofing material. However, when attempting to form the cutout at the end portion of the metal roofing material as described above, complicated steps will be required and manufacturing costs will be increased, because the metal roofing material has a complex structure.

The present invention has been made to solve the above problems. An object of the present invention is to easily perform alignment in disposing roof materials on a roof base while suppressing an increase in manufacturing costs.

Solution to Problem

A metal roofing material according to the present invention comprises: a front substrate made of a metal sheet, the front substrate comprising a body portion formed in a box shape; a back substrate disposed on a back side of the front substrate so as to cover an opening of the body portion; a core material filled between the body portion and the back substrate, the metal roofing material being arranged side by side on a roof base together with other metal roofing materials, wherein at least one edge indicator in the form of protrusion is provided at an edge portion of a top plate of the body portion.

Advantageous Effects of Invention

According to the metal roofing material of the present invention, the alignment in disposing roof materials on a roof base can be easily performed while suppressing an increase in manufacturing costs, because at least one edge indicator in the form of protrusion is provided at the edge portion of the top plate of the body portion.

DESCRIPTION OF THE PREFERRED EMBODIMENTS

Embodiments for carrying out the present invention will be described with reference to the drawings.

Embodiment 1

Figure 1:
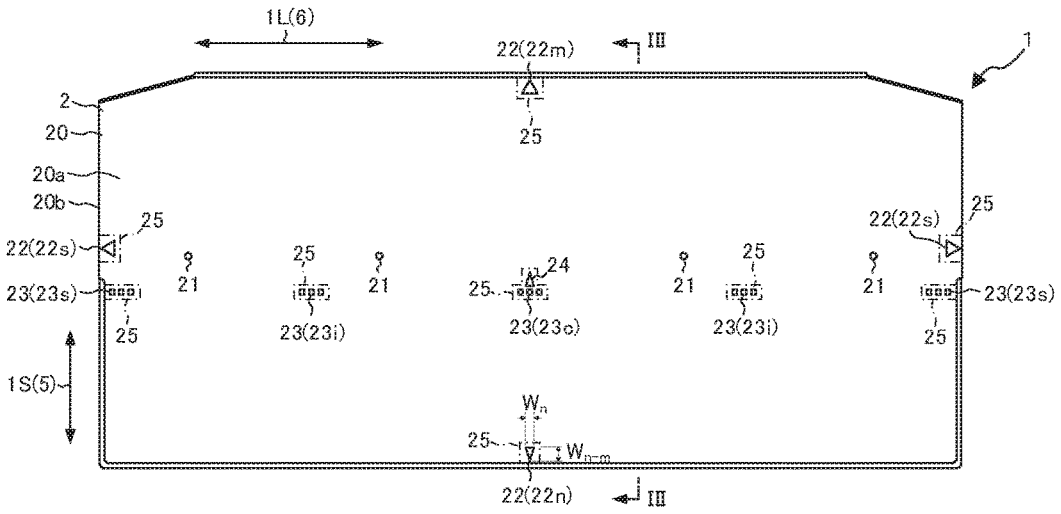
FIG. 1 is a front view showing a metal roofing material according to an embodiment 1 of the present invention.
Figure 2:
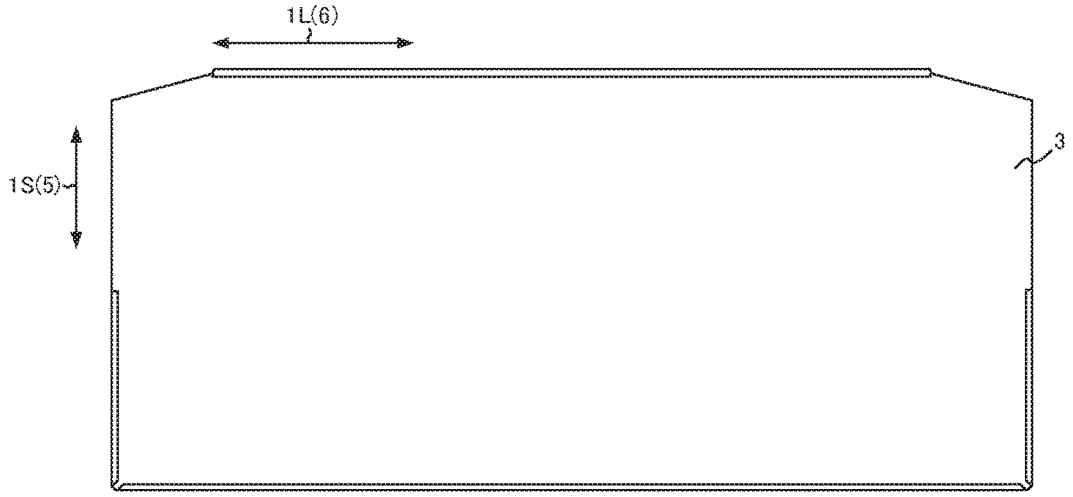
FIG. 2 is a back view showing the metal roofing material 1 of FIG. 1.
Figure 3:
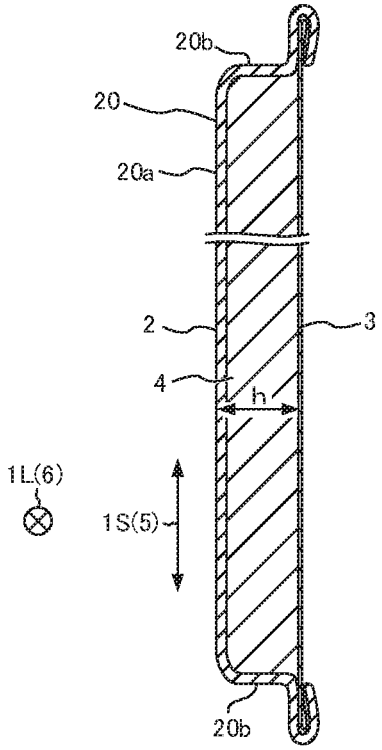
FIG. 3 is a cross-sectional view of a metal roofing material taken along the line III-III in FIG. 1.
Figure 4:
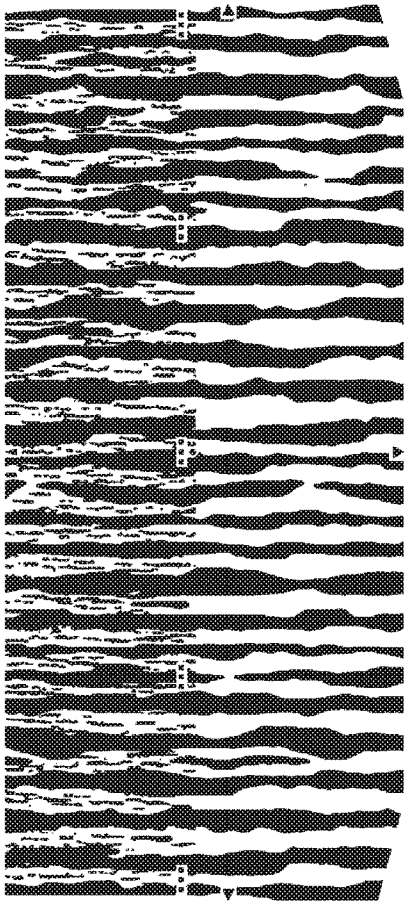
FIG. 4 is an explanatory view showing an example of a flow pattern provided on a top plate in FIG. 1.

FIG. 1 is a front view showing a metal roofing material 1 according to an embodiment of the present invention, FIG. 2 is a back view showing the metal roofing material 1 of FIG. 1, FIG. 3 is a cross-sectional view of the metal roofing material 1 taken along a line III-III in FIG. 1, and FIG. 4 is an explanatory view showing an example of a flow pattern provided on a top plate in FIG. 1.

A metal roofing material 1 shown in FIGS. 1 to 3 is a member that has a substantially rectangular shape as viewed in a plane and has a short direction (depth direction) and a longitudinal direction (width direction). For example, the metal roofing material 1 is arranged on a roof base in a roof of a house or the like. As will be described below with reference to the drawings, the metal roofing material 1 is arranged on the roof base such that the short direction is along an eave-ridge direction 5 of the roof and the longitudinal direction is along an eave direction 6 orthogonal to the eave-ridge direction 5 (a direction parallel to the eave) (see FIG. 5). Hereinafter, the short direction of each of the metal roofing material 1 and a top plate 20*a* of a front substrate 2 is referred to as an eave-ridge direction 1S, and the longitudinal direction thereof is referred to as an eave direction 1L. As shown in FIGS. 1 to 3, the metal roofing material 1 includes a front substrate 2, a back substrate 3, and a core material 4.

<Regarding Front Substrate>

The front substrate 2 is a metal member that is made of a metal sheet and that appears on the outer surface of the roof as the metal roofing material 1 is placed on the roof base. As can be particularly seen from FIG. 3, the front substrate 2 is provided with a box-shaped body portion 20 including a top plate 20*a* and a peripheral wall 20*b*.

The metal sheet making up the front substrate 2 that can be used includes a hot-dip Zn plated steel sheet, a hot-dip Al plated steel sheet, a hot-dip Zn plated stainless steel sheet, a hot-dip Al plated stainless steel sheet, a stainless steel sheet, an Al sheet, a Ti sheet, a coated hot-dip Zn plated steel sheet, a coated hot-dip Al plated steel sheet, a coated hot-dip Zn plated stainless steel sheet, a coated hot-dip Al plated stainless steel sheet, a coated stainless steel sheet, a coated Al sheet or a coated Ti sheet. When the front substrate 2 is formed into a box shape, the front substrate 2 may be preferably formed by means of drawing processing of the steel sheet, because the drawing processing of the steel sheet results in work hardening in the peripheral wall 20*b*, so that the wind pressure resistance performance of the metal roofing material 1 can be improved, and the peripheral wall 20*b* can be a wall surface continuous in the circumferential direction of the front substrate 2.

<Regarding Back Substrate>

The back substrate 3 is arranged on the back side of the front substrate 2 so as to covert an opening of the body portion 20. The opening of the body portion 20 is bordered with an inner edge of an end portion on an opposite side to the top plate of the peripheral wall 20*b* of the body portion 20. The back substrate 3 that can be used include lightweight materials such as aluminum foil, aluminum vapor deposited paper, aluminum hydroxide paper, calcium carbonate paper, resin films or glass fiber paper and the like. The use of these lightweight materials for the back substrate 3 allows prevention of an increase in the weight of the metal roofing material 1.

<Regarding Core Material>

The core material 4 is made of, for example a foamed resin or the like, and is filled between the body portion 20 and the back substrate 3. The material of the core material 12 includes, but not limited to, for example, urethane, phenol and cyanurate resins. For roofing materials, however, certified noncombustible materials must be used. The test for certification of noncombustible material is conducted by a heat release test according to the cone calorimeter test method defined in ISO 5660-1. If the foamed resin for forming the core material 4 is urethane having a higher calorific value, the thickness of the core material 4 may be decreased, or inorganic expandable particles may be incorporated into the foamed resin. The filling of the foamed resin between the body portion 20 and the back substrate 3 can lead to a stronger adhesion of the core material 4 to the back surface of the front substrate 2 as compared with an embodiment where a backing material such as a resin sheet or the like is attached onto the back side of the front substrate 2, so that the performance required for the roofing materials, such as rainfall noise reduction, heat insulation and tread-down properties, can be improved.

<Regarding Top Plate of Front Substrate>

As shown in FIG. 1, the top plate 20*a* of the front substrate 2 is provided with a plurality of tightening holes 21; a plurality of edge indicators 22; a plurality of eave direction indicators 23; and an auxiliary indicator 24.

The tightening holes 21 are provided so as to be separated from each other in the eave direction 1L of the top plate 20*a*, and indicate driving positions of tightening members 8 (see FIG. 6) into the metal roofing material 1. Each tightening member 8 is comprised of, for example, a screw or a nail or the like and is used to fasten the metal roofing material 1 to the roof base. While the present embodiment discloses that the fastening holes 21 are provided on the front substrate 2, the top plate may be provided with non-opening type marks indicating driving positions of the tightening members such as printed symbols and irregularities, in place of the tightening holes 21.

Each of the plurality of edge indicators 22 is protrusion provided on an edge portion of the top plate 20*a*. The edge portion of the top plate 20*a* is a region having a certain width from the end of the top plate 20*a* and extending so as to surround the top plate 20*a*. Each edge indicator 22 can be formed by performing a forming process such as pressing or embossing on a metal sheet which is a material of the front substrate 2, for example. Therefore, the edge indicators 22 can be easily formed on the front substrate 2, and the manufacturing cost of the metal roofing material 1 can be reduced, as compared with a case where a cutout is formed at the end portion of the front substrate 2. As will be described below with reference to the drawings, when the metal roofing material 1 is placed on the roof base together with other metal roofing materials 1, the metal roofing material 1 can be aligned using the edge indicators 22. Further, when providing the cutout at the end portion of the roofing material, the cutout may be caught by other member, so that the roofing material and other members may be damaged. However, for the configuration of the present embodiment, such a problem can also be avoided.

The metal roofing material 1 according to the present embodiment is provided with, as the edge indicators 22, a pair of side edge indicators 22*s* provided on both edges of the top plate 20*a* in the eave direction 1L; an eave edge indicator 22*n* provided on an eave side of the top plate 20*a*; and a ridge edge indicator 22*m* provided on a ridge side of the top plate 20*a*. The eave edge indicator 22*n* and the ridge edge indicator 22*m* are disposed at the center position of the top plate 20*a* in the eave direction 1L, respectively. By using these side edge indicators 22*s*, eave edge indicator 22*n* and the ridge edge indicator 22*m*, the respective metal roofing materials 1 can be more surely aligned in the eave direction 5 and eave direction 6 of the roof. However, any of the side edge indicators 22*s*, the eave edge indicator 22*n*, and the ridge edge indicator 22*m* may be omitted. That is, the top plate 20 may be provided with at least one edge indicator 22 serving as a mark for alignment.

Each edge indicator 22 is formed to have a triangular shape when viewed in a plane as shown in FIG. 1, and is disposed such that that each corner portion is directed to an outer side of the edge portion of the top plate 20*a*. The outer side of the edge portion of the top plate 20*a* means a region where the top plate 20*a* does not extend beyond the end of the top plate 20*a*. Since the corner portions are arranged so as to be directed to the outside of the edge portion of the top plate 20*a*, the positions indicated by the respective edge indicators 22 can be made clearer, and the accuracy of the alignment of the metal roofing materials 1 can be improved. It should be noted that each of the tops of the corner portions of the eave edge indicator 22*n* and the ridge edge indicator 22*m* is positioned at the center position of the top plate 20*a* in the eave direction 1L. Further, the outer shape of each edge indicator 22 is preferably an outer shape having a corner portion when viewed in a plane as shown in FIG. 1, and may be, for example, a rhombus shape or the like.

An eave direction extending width $W_n$ of the eave edge indicator 22*n* along the eave direction 1L of the top plate 20*a* is narrower than an eave-ridge direction extending width $W_{n-m}$ of the eave edge indicator 22*n* along the eave-ridge direction 1S of the top plate 20*a*. In other words, the eave edge indicator 22*n* is formed so as to be thin in the eave-ridge direction 1S and to be long in the eave direction 1L. The eave edge indicator 22*n* is provided on the eave side of the top plate 20*a*. Therefore, it is assumed that the eave edge indicator 22*n* is exposed without being covered with the other metal roofing materials. As described above, the eave edge indicator 22*n* is formed so as to be thin, so that any risk that the eave edge indicator 22*n* prevents the flow of moisture such as rainwater can be reduced, while ensuring the visibility of the eave edge indicator 22*n*. Further, when the top plate 20*a* is provided with a concave and convex pattern as described below, the eave edge indicator 22*n* is formed so as to be thin, whereby the eave edge indicator 22*n* naturally matches the patterns, and an effect that the indicator 22*n* does not prevent the design property of the patterns can be obtained.

The plurality of eave direction indicators 23 are protrusions arranged along the eave direction 1L of the top plate 20*a*. In other words, the plurality of eave direction indicators 23 are spaced apart from each other on a straight line extending in the eave direction 1L. By thus arranging the plurality of eave direction indicators 23 along the eave direction 1L, when placing the other metal roofing materials by overlapping on the metal roofing material 1, these metal roofing materials can be more surely arranged in parallel. When placing the other metal roofing materials on the metal roofing material 1, the eave direction indicators 23 are preferably arranged at positions hidden by the other metal roofing materials.

By using the side edge indicator 22*s*, eave edge indicator 22*n* and ridge edge indicator 22*m* as described above, the respective metal roofing materials 1 can be aligned in the eave direction 5 and the eave direction 6 of the roof. However, by using the eave direction indicators 23, even if one of the side edge indicator 22*s*, the eave edge indicator 22*n* and the ridge edge indicator 22*m* is omitted, the other metal roofing materials can be easily and accurately arranged on the metal roofing material 1. Further, in a verge or a ridge portion of the roof, the metal roofing material 1 may be cut into arbitrary dimensions and used. When the metal roofing material 1 is cut, a part of the edge indicator 22 may be missing. Even in such a case, the eave side end of the metal roofing material 1 is aligned based on the eave direction indicators 23, whereby it is possible to easily and accurately align the metal roofing materials 1. The eave side edge of each eave direction indicator 23 extends along the eave direction 1L.

In the present embodiment, the metal roofing material 1 includes, as the eave direction indicators 23, a pair of side indicators 23*s* provided at both edges of the top plate 20*a* in the eave direction 1L; a central indicator 23*c* provided at a center of the top plate 20*a* in the eave direction 1L; and a pair of intermediate indicators 23*i* arranged between the side indicator 23*s* and the central indicator 23*c*. The side indicators 23*s*, the central indicator 23*c* and the intermediate indicators 23*i* are constituted by three protrusions arranged to be separated in the eave direction 1L. By constituting the side indicators 23*s*, the central indicator 23*c* and the intermediate indicators 23*i* by the tree protrusions arranged to be separated in the eave direction 1L, a central position of each of the indicators 23*s*, 23*c* and 23*i* in the eave direction 1L can be easily recognized. The constitution is particularly useful when cutting the metal roofing material 1 along a straight line extending in the eave-ridge direction 1S, for example when cutting the metal roofing material 1 in half at the central position in the eave direction 1L. It should be noted that the number of protrusions constituting each of the indicators 23*s*, 23*c*, and 23*i* is preferably an odd number, and may be 1, 5, or the like, for example. However, in terms of easy recognition of the central position of each eave direction indicator 23 while spreading each eave direction indicator 23 in the eave direction 1L, the number of protrusions constituting the eave direction indicators 23 may more preferably be an odd number of 3 or more.

The auxiliary indicator 24 is a protrusion extending to be long at a center in the eave direction 1L of the top plate 20*a* and at a middle position in the eave-ridge direction 1S of the top plate 20*a*. The auxiliary indicator 24 of the present embodiment has a triangular outer shape elongated in the eave-ridge direction 1S and is disposed near the central indicator 23*c*. When the other metal roofing materials are overlapped with and placed over the metal roofing material 1, the end surface of the other metal roofing material and the auxiliary indicator 24 can be matched together and arranged. When placing the other metal roofing material on the metal roofing material 1, the auxiliary indicator 24 is preferably arranged at a position hidden by the other metal roofing material.

On the top plate 20*a*, a concave and convex pattern can be formed. As the pattern, for example, a flow pattern as shown in FIG. 4 can be adopted. Each dark part in FIG. 4 shows a top part of each convex portion forming the pattern. The flow pattern is a pattern in which irregularities are arranged linearly along the eave-ridge direction 1S of the top plate 20*a* so as not to obstruct the flow of moisture such as rainwater along the eave-ridge direction 1S of the top plate 20*a*. The flow pattern that can be used includes a pattern as disclosed in Japanese Patent Application Publication No. 2015-71927 A or the like. When the concave and covex pattern is formed on the top plate 20*a*, flat portions 25 with no pattern as described above are preferably formed around (for example, in the regions indicated by the one-dot chain lines in FIG. 1 or the like) the edge indicator 22, the eave direction indicator 23 and the auxiliary indicator 24. Each flat portion 25 appears as a bright portion located around each dark portion corresponding to the edge indicators 22, the eave direction indicators 23, and the auxiliary indicator 24 in FIG. 4.

The upper surfaces of the edge indicators 22, the eave direction indicators 23 and the auxiliary indicator 24 may each have the same color as that of the top plate 20*a*, but they may be preferably colored with a color different from that of the top plate 20 around the edge indicator 22, eave direction indicator 23 and auxiliary indicator 24. By thus coloring the upper surfaces of the edge indicator 22, eave direction indicator 23 and auxiliary indicator 24 and the top plate 20*a* around them with different colors, the visibility of the edge indicators 22, the eave direction indicators 23 and the auxiliary indicator 24 can be improved. For example, when the top plate 20*a* around the edge indicators 22, the eave direction indicators 23, and the auxiliary indicator 24 is a brown color, the upper surfaces of the edge indicator 22, eave direction indicator 23, and auxiliary indicator 24 may be white, yellow, red or black color.

In particular, the edge indicators 22, the eave direction indicators 23, and the auxiliary indicator 24 other than the eave edge indicator 22*n* are covered and hidden by the other metal roofing materials 1, so that they will be located in parts invisible after construction. Therefore, remarkable colors, i.e., a complementary color of the surrounding colors and the similar color of the complementary color can be selected.

On the other hand, since the eave edge indicator 22*n* is located at a position that is visible even after the roof construction, it is preferable to select a similar color of the color around the eave edge indicator 22*n*. For example, when the periphery of the eave edge indicator 22*n* is a brown color, the eave edge indicator 22*n* is preferably a dark brown color, a black color, or the like.

Further, when the concave and convex pattern is formed on the top plate 20*a*, the convex portions can be colored with a color different from that of the flat portions 25, thereby improving designability. In such a case, it is possible to perform more efficient work by applying the same printing simultaneously to the edge indicators 22, the eave direction indicators 23 and the auxiliary indicator 24.

Further, when the concave and convex pattern is formed on the top plate 20*a* and the convex portions of the pattern are colored with a color different from the flat portions 25 with no pattern formed, the edge indicators 22, the eave direction indicator 23, and the auxiliary display 24 are provided with periphery parts (for example, the regions indicated by the one-dot chain lines in FIG. 1, or the like), whereby the presence of the edge indicators 22, eave direction indicators 23 and auxiliary indicator 24 can be further clarified.

It is preferable that the height positions of the upper surfaces of the edge indicators 22, the eave direction indicators 23 and the auxiliary indicator 24 are equal to the height position of the upper surface of the pattern formed on the top plate 20*a*. By making the height positions of these upper surfaces equal, the edge indicators 22, the eave direction indicators 23, the auxiliary indicator 24, and the pattern can be correctively formed more reliably. Further, the edge indicators 22, the eave direction indicators 23, the auxiliary indicator 24, and the upper surface of the pattern can be collectively colored.

It should be noted that the heights of the edge indicators 22, the eave direction indicators 23, the auxiliary indicator 24 and the side walls of the pattern (the height position of the upper surface) may be different from each other, but they may be in a range of 0.2 mm or more and 2.0 mm or less.

The height of each side wall of 0.2 mm or more can ensure good distinguishability among the edge indicator 22, the eave direction indicator 23, and the auxiliary indicator 24. If the height of each side wall is less than 0.2 mm, there is a risk that printing stain may occur around each indicator and the convex portions of the pattern when coloring is applied to them.

If the height of each side wall is more than 2.0 mm, a relatively large gap will be generated in a heavy portion where the metal roofing materials 1 overlap with each other, so that there is a risk that a wind resistance performance and a water stopping property may be decreased. Further, there are risks of generating cracking of the metal sheet itself forming the front substrate 1 and cracking of a plated layer or coated film provided on the surface of the metal sheet. Such cracking reduces corrosion resistance of the metal roofing material 1.

Figure 5:
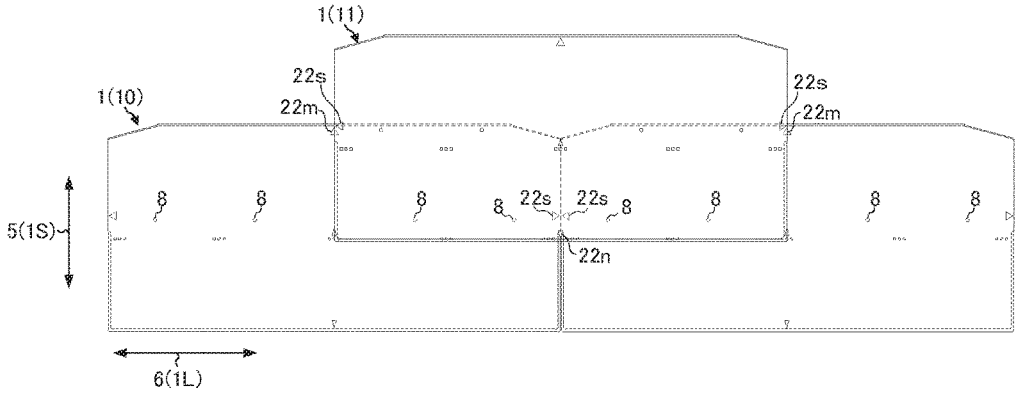
FIG. 5 is an explanatory view showing a roofing structure using the metal roofing material of FIG. 1.
Figure 6:
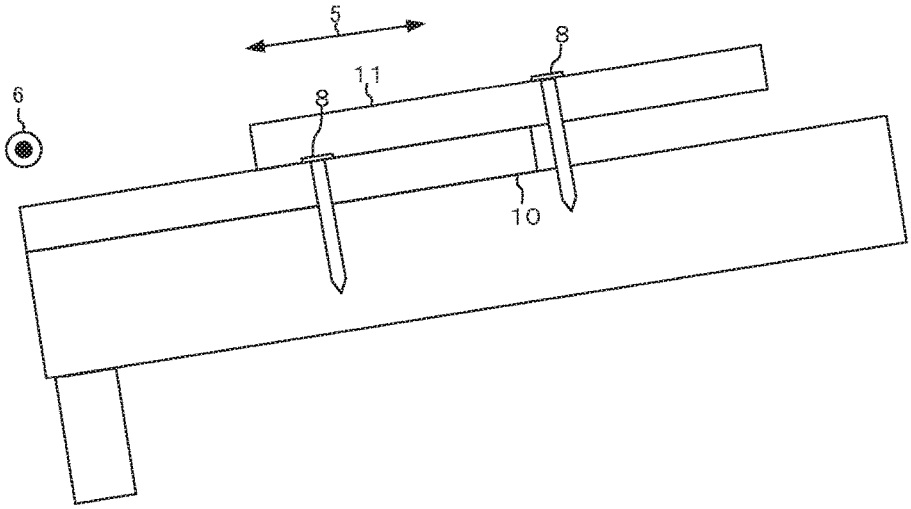
FIG. 6 is a side view showing two metal roofing materials that overlap with each other in FIG. 5.

Next, FIG. 5 is a plan view showing a roofing structure using the metal roofing material 1 of FIG. 1, and FIG. 6 is a side view showing two metal roofing materials overlapping with each other in FIG. 5. With regard to the eave-ridge direction 5 in FIG. 5, the upper side of FIG. 5 is the ridge side and the lower side is the eave side. Further, with regard to the eave-ridge direction 5 in FIG. 6, the right side of FIG. 6 is the ridge side and the left side is the eave side. As shown in FIG. 5, for the metal roofing material 1 of FIG. 1, a plurality of metal roofing materials 1 are arranged side by side on the roofing base while butting their side edges against each other in the eave direction 6 parallel to the eave of the building. Each metal roofing material 1 is arranged on the roofing base such that the longitudinal direction is along the eave direction 6 and the short direction is along the eave-ridge direction 5 of the roof. In this case, by butting the side edge indicators 22*s* of the respective metal roofing materials 1 with each other, the alignment of the metal roofing materials 1 in the eave-ridge direction 5 is performed. After arranging the metal roofing materials 1 on the roof base, the tightening members 8 such as screws or nails are driven into the metal roofing materials 1, and the tightening members 8 are fixed to the roof base.

Further, with regard to the eave-ridge direction 5, the metal roofing materials 1 are placed on the roofing base while the eave side end portion of the metal roofing material 1 (11) on the ridge side (the upper side in FIG. 5 and the right side in FIG. 6) is overlapped onto the ridge side end portion of the metal roofing material 1 (10) on the eave side (the lower side in FIG. 5 and the left side in FIG. 6). In this case, the eave edge indicator 22*n* of the metal roofing material 1 (11) on the ridge side is matched with the butted side end of the metal roofing material 1 (10) on the eave side, and the side end of the metal roofing material 1 (11) on the ridge side is matched with the ridge edge indicator 22*m* of the metal roofing material 1 (10) on the eave side, and the side edge indicator 22*s* of the metal roofing material 1 (11) on the ridge side is further matched with the ridge side end of the metal roofing material 1 (10) on the eave side, thereby aligning the metal roofing material 1 (11) on the ridge side with the metal roofing material 1 (10) on the eave side.

Further, when the ridge edge indicator 22*m* or the eave edge indicator 22*n* is not used or when the ridge edge indicator 22*m* or the eave edge indicator 22*n* cannot be used for alignment due to cutting or the like as described above, the eave direction indicators 23 and any one of the ridge edge indicator 22*m* and the eave edge indicator 22*n* can be used to perform the alignment in the same method as described above. In this case, the eave side end of the eave direction indicator 23 of the metal roofing material 1 (10) is matched with the eave side edge of the metal roofing material 1 (11). Even if it is a part of the metal roofing material 1 (11) which cannot use either the ridge edge indicator 22*m* or the eave edge indicator 22*n*, the overlap roofing can be performed along the eave direction indicators 23 of the metal roofing material 1 (10).

EXAMPLES

Next, Examples are provided. The present inventors experimentally produced a sample of the metal roofing material 1 under the following conditions:

For the front substrate 2, a coated hot-dip Zn-55% Al plated stainless steel sheet having 0.3 mm was used. On the top plate 20*a*, a concave-convex pattern was formed by bulging with a pressing machine. For the concave-convex pattern, the flow pattern shown in FIG. 4 was adopted, and the height of each convex pattern relative to each flat portion 25 where the convex pattern was not formed was 0.3 mm.

As the edge indicators 22, a pair of side edge indicators 22*s* was provided on both edge portions of the top plate 20*a* in the eave direction 1L, and the eave direction indicators 23 and the auxiliary indicator 24 were also provided on the top plate 20*a*. Further, the eave edge indicator 22*n* was provided on the eave side of the top plate 20*a* and the ridge edge indicator 22*m* was provided on the ridge side of the top plate 20*a*. The eave edge indicator 22*n* and the ridge edge indicator 22*m* were disposed at the central position of the top plate 20*a* in the eave direction 1L.

The side edge indicators 22*s* and the ridge edge indicator 22*m* were formed so as to be an equilateral triangle having a side of 10 mm when viewed in a plane, and arranged so that the corner portions were directed to the outer side of the edge portions of the top plate 20*a*.

The eave edge indicator 22*n* was in the form of an isosceles triangle having an eave direction extending width $W_n$ of 5 mm and an eave-ridge direction extending width $W_{n-m}$ of 10 mm.

Provided were the central indicator 23*c* arranged at the center of the top plate 20*a* in the eave direction 1L and a pair of intermediate indicators 23*i* arranged between those side indicators 23*s* and the central indicator 23*c*. Each of the side indicator 23*s*, the central indicator 23*c* and the intermediate indicator 23*i* was constituted by three protrusions arranged to be separated from each other in the eave direction 1L.

The eave edge indicator 22, the plurality of eave direction indicator portions 23 and the auxiliary indicator 24 disposed on the top plate 20*a* were formed by means of a bulging process with a pressing machine simultaneously with the flow pattern composed of the irregularities. The formed heights (the height of each side wall of each indicator) of the eave edge indicator 22, the plurality of eave direction indicators 23 and the auxiliary indicator 24 relative to the flat portion 25 where no pattern was formed were changed in a range of from 0.1 to 2.1 mm.

Printing (coloring) on the top plate 20*a* was carried out by a flexographic printing method using a printing machine from Newlong Machine Works, Ltd. For the ink, a silicone acrylic resin-based black ink was used. After the ink was printed by a urethane roll, it was dried at 70° C. for 5 minutes. Each film thickness of the ink at the convex portions of the edge indicator 22 and the plurality of eave direction indicators 23 was 6 μm after drying. The film thickness of the ink was adjusted according to printing conditions such as hardness of the roll, an amount of ink coated, gap adjustment between roll/printing substrate, and the like.

After processing the front substrate 2 to have a predetermined roofing material thickness and shape and printing it, the back substrate 3 was disposed on the back side of the front substrate 2 so as to cover the opening of the body portion 20, and a commercially available foaming resin was injected into the space between the body portion 20 of the front substrate 2 and the back substrate 3 by means of a commercially available high pressure injection machine. As the backing substrate 3, a glass fiber paper having 0.2 mm was used. As the core material 4, a two-part mixing type foaming resin was used. The mixing ratio of the polyol component and the cyanurate component was 1:1 in a weight ratio. The foaming of the resin was maintained for 2 minutes in a mold whose temperature was adjusted to 70° C. by warm water circulation, and the roofing material was then taken out from the mold and allowed to stand for 5 minutes at room temperature of 20° C. to complete the foaming of the resin.

Using the above samples, the present inventors performed (1) evaluation of distinguishability, (2) evaluation of printability to convex portions (adhering of printing stain to the flat portions), and (3) a degree of occurrence of a gap of the roofing material. The results are shown in the table below:

TABLE 1

Evaluation of Samples

| | Items of Sample | | Evaluation Results | | |
|---|---|---|---|---|---|
| | Presence or Absence of Printing | Formed Height (mm) for flat Portion | Distinguish-ability | Printability to Convex Portions (Adhering of Printing Stain to Flat Portions) | Degree of Occurrence of Gap of Roofing Material |
| Examples | Absence | 0.2 | ○ | — | ○ |
| | Absence | 0.5 | ○ | — | ○ |
| | Presence | 0.5 | ◎ | ○ | ○ |
| | Presence | 2.0 | ◎ | ○ | ○ |
| Comparative Examples | Absence | 0.1 | X | — | ○ |
| | Presence | 0.15 | X | X | ○ |
| | Presence | 2.1 | ◎ | ○ | X |

(1) Evaluation of Distinguishability

Each roofing material 1 was installed outdoors such that the eave-ridge direction of the roofing material 1 was vertical, and the roofing material 1 was visually evaluated from an angle of 45°. The evaluation was carried out by selecting the day of fine weather and evaluated according to the following criteria:

◎: Very easily distinguishable;

○: Easily distinguishable;

Δ: Distinguishable; and x: Not distinguishable.

As shown in Table 1, when the formed heights of the respective indicators 22, 23, 24 were less than 0.2 mm, it was difficult to distinguish the respective indicators 22, 23, 24. Therefore, it was found that the formed height of each indicator 22, 23, 24 was preferably 0.2 mm or more, in terms of the distinguishability of each indicator 22, 23, 24.

(2) Evaluation of Printability to Convex Portions (Adhering of Printing Stain to Flat Portions)

Stains caused by ink adhesion to the flat portions 25 were evaluated according to the following criteria:

○: No adhesion of ink to the flat portions;

Δ: Slight adhesion of ink to the flat portions; and x: Adhesion of ink to the flat portions.

When the formed height of each of the indicators 22, 23, 24 was less than 0.2 mm, the ink adhered to the flat portions 25, causing stains. It was also found from the viewpoint of printing stain that the formed height of each of the indicators 22, 23, 24 was preferably 0.2 mm or more.

(3) Evaluation Criteria for Degree of Occurrence of Gap of Roofing Material

A commercially available waterproof sheet was affixed to a surface of roofing board (a thickness of 12 mm), and a simulating roof in which four roofing materials were roofed with an inclination angle of 30° by the overlap roof construction as shown in FIG. 5. The gap between the metal roofing material 1 (10) and the metal roofing material 1 (11) near the eave direction indicator 23 was measured with a gap gauge and evaluated according to the following criteria:

○: Gap of less than 1 mm;

Δ: Gap of 1 mm or more and less than 2 mm; and x: Gap of 2 mm or more.

It was found that the gap became larger when the formed height of each indicator 22, 23, 24 was more than 2.0 mm. Thus, it was confirmed that the formed height of each of the indicators 22, 23, 24 was preferably 2.0 mm or less.

In such a metal roofing material, the edge portion of the top plate 20*a* of the body portion 20 is provided with at least one edge indicator 22 in the form of protrusion, so that the work load can be reduced while suppressing an increase in the manufacturing cost and the alignment in placing the metal roofing material on the roof base, as compared with a case where a cutout is formed at the end portion of the front substrate 2 or a case of marking or inking with a pencil or chalk.

Further, since the edge indicator 22 includes a pair of side edge indicators 22*s* provided on both edge portions of the top plate 20*a* in the eave direction 1L, when a plurality of metal roofing materials 1 are arranged side by side in the eave direction 6, the alignment of the metal roofing materials 1 in the eave-ridge direction 5 of the metal roofing material 1 can be carried out more reliably.

Further, since the edge indicator 22 includes the eave edge indicator 22*n* provided on the eave side of the top plate 20*a*, the alignment of the metal roofing materials 1 can be carried out more reliably when the other metal roofing materials 1 are overlapped with the metal roofing material 1.

Furthermore, since the eave direction extending width $W_n$ of the eave edge indicator 22*n* along the eave direction 1L of the top plate 20*a* is narrower than the eave-ridge direction extending width $W_{n-m}$ of the eave edge indicator 22*n* along the eave-ridge direction 1S of the top plate 20*a*, it is possible to reduce a risk that the eave edge indicator 22*n* hinders the flow of moisture such as rainwater while ensuring the visibility of the eave edge indicator 22*n*. In addition, since the eave-ridge direction extending width $W_{n-m}$ of the eave edge indicator 22*n* is narrowed, when the concave and convex pattern is provided on the top plate 20*a*, a risk that the eave edge indicator 22*n* hinders the design property due to the pattern can be reduced.

Further, since the edge indicators 22 includes the ridge edge indicator 22*m* provided on the ridge side of the top plate 20*a*, the alignment of the metal roofing materials 1 can be carried out more reliably when the other metal roofing materials are overlapped with the metal roofing material 1.

Further, since the edge indicator 22 has an outer shape in which it has corner portions when viewed in a plane and the corner portions are arranged so as to be directed to the outer side of the edge portion, it is possible to improve the accuracy in aligning the roofing materials using the edge indicator 22.

Furthermore, since the flat portions 25 with no pattern are formed around the edge indicators 22, the visibility of the edge indicators 22 can be improved.

In addition, since the upper surface of the edge indicator 22 is colored with a color different from that of the top plate 20*a* around the edge indicator 22, the visibility of the edge indicator 22 can be improved.

Furthermore, the top plate 20*a* is further provided with a plurality of protruding eave direction indicators 23 arranged along the eave direction 1L of the top plate 20*a*, so that when the other metal roofing materials are overlapped with the metal roofing material 1, their metal roofing materials can be more reliably arranged in parallel.

Moreover, since the eave direction indicators 23 are constituted by protrusions having an odd number, spaced in the eave direction 1L, it can be easy to recognize the center position of each eave direction indicator 23 in the eave direction 1L. This configuration is particularly useful when cutting the metal roofing material 1 along a straight line extending in the eave-ridge direction 1S.

The top plate 20*a* further includes the protruding auxiliary indicator 24 extended to be long at the center of the top plate 20*a* in the eave direction 1L and at the intermediate position of the top plate 20*a* in the eave-ridge direction 1S, so that it is possible to align more reliably the metal roofing materials 1 when the other metal roofing materials 1 are overlapped with the metal roofing material 1.

Further, when cutting the body 20 in half in the eave-ridge direction 1S (5) direction, the use of the edge indicators 22*m*, 22*n*, the eave direction indicator 23*c* or the auxiliary indicator 24 can allow more accurate cutting.

Embodiment 2

Figure 7:
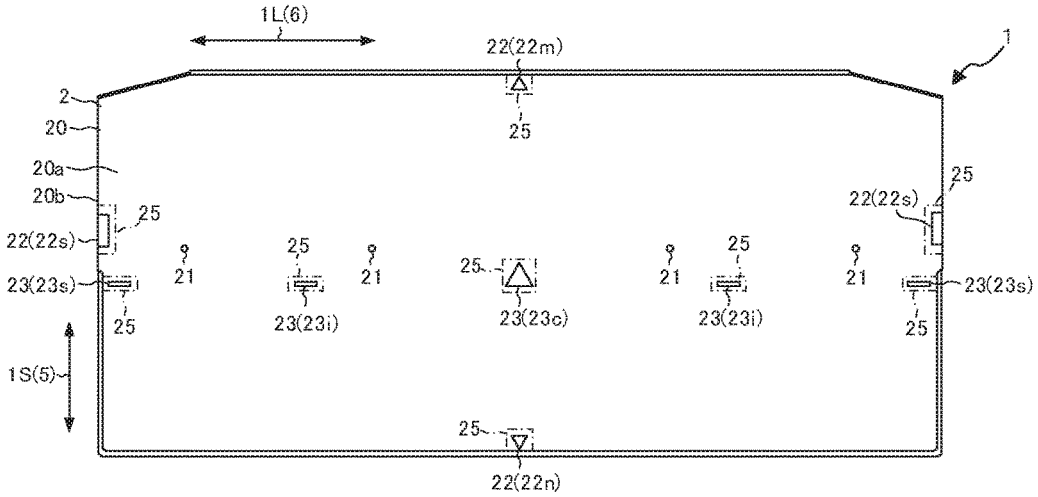
FIG. 7 is a front view showing a metal roofing material according to Embodiment 2 of the present invention.

FIG. 7 is a front view showing a metal roofing material 1 according to Embodiment 2 of the present invention. In the embodiment 1, the side indicators 23*s* and the intermediate indicators 23*i* of the eave direction indicator 23 have been described as being constituted by three protrusions disposed apart from each other in the eave direction 1L. However, as shown in FIG. 7, each of the side indicators 23*s* and the intermediate indicators 23*i* may be constituted by one rectangle in which an eave side end side extends along the eave direction 1L. By thus configuring each of the side indicators 23*s* and the intermediate indicators 23 with one rectangle, it is possible to improve the distinguishability of the eave side edges of the side indicators 23*s* and the intermediate indicators 23*i*, and it is possible to align accurately the metal roofing materials 1 on the ridge side using the eave side edges of the side indicators 23*s* and the intermediate indicators 23*i*.

Further, in the embodiment 1, the central indicator 23*c* has been described to be constituted by three projections which are spaced apart in the eave direction 1L. However, as shown in FIG. 7, the central indicator 23*c* may be constituted by protrusion having an outer shape of a triangle as viewed in the plane. The central indicator 23*c* has corners that taper toward the outside of the top plate 20*a* along the eave-ridge direction 1S, and arranged such that the top portion of the corners is placed at the center of the top plate 20*a* in the eave direction 1L. In addition, the eave side edge of the central indicator 23*c* extends along the eave direction 1L. By thus configuring the central indicator 23*c*, it is possible to distinguish more reliably the center position of the top plate 20*a* in the eave direction 1L. In addition, more accurate alignment of the metal roofing materials 1 on the ridge side can be carried out using the eave side edges of the central indicator 23*c* with the eave side edges of the side indicators 23*s* and the intermediate indicator 23 as described above. Furthermore, the auxiliary indicator 24 of the first embodiment may be omitted. As with the central indicator 23*c*, each of the side indicators 23*s* and the intermediate indicators 23*i* may be constituted by a protrusion having a triangular outer shape when viewed in the plane.

Further, in the first embodiment 1, the eave edge indicator 22*n* has been described to be constituted by an isosceles triangle that is thin in the eave-ridge direction 1S and long in the eave direction 1L. However, the eave edge indicator 22*n* may be constituted by an equilateral triangle. It is possible to improve the distinguishability of the eave edge indicator 22*n*.

In the embodiment 1, the side edge indicators 22*s* have been described to be constituted by triangular protrusions. However, as shown in FIG. 7, each side edge indicator 22*s* may be constituted by a quadrangular protrusion when viewed in the plane. That is, the shape of each indicator may be changed as needed. In addition, by constituting the side edge indicator 22*s* with the quadrangular protrusion, it is possible to align accurately the metal roofing materials 1 on the ridge side using the eave side edge of the side edge indicator 22*s*.

What is claimed is:

1. A metal roofing material comprising:

a front substrate made of a metal sheet, the front substrate comprising a body portion formed in a box shape;

a back substrate disposed on a back side of the front substrate so as to cover an opening of the body portion; and a core material filled between the body portion and the back substrate, the metal roofing material being arranged side by side on a roof base together with other metal roofing materials, wherein at least one edge indicator in the form of a protrusion is provided at an edge portion of a top plate of the body portion, and wherein the edge indicator includes an eave edge indicator provided on the eave side of the top plate and a ridge edge indicator provided on a ridge side of the top plate, an eave direction extending width of the eave edge indicator along an eave direction of the top plate being narrower than an eave-ridge direction extending width of the eave edge indicator along an eave-ridge direction of the top plate, and an eave direction extending width of the ridge edge indicator along the eave direction of the top plate being broader than the eave direction extending width of the eave edge indicator along the eave direction of the top plate.

2. The metal roofing material according to claim 1, wherein the edge indicator includes a pair of side edge indicators provided on both edge portions of the top plate in an eave direction.

3. The metal roofing material according to claim 2, wherein each eave side end edge of the side edge indicators extends along the eave direction.

4. The metal roofing material according to claim 1, wherein the edge indicator has an outer shape in which it has corner portions when viewed in a plane, and wherein the corner portions are arranged so as to be directed to an outer side of the edge portion.

5. The metal roofing material according to claim 1, wherein the top plate has a concave and convex pattern, and wherein flat portions without the pattern are formed around the edge indicator.

6. The metal roofing material according to claim 1, wherein an upper surface of the edge indicator is colored with a color different from that of the top plate around the edge indicator.

7. The metal roofing material according to claim 1, wherein the edge indicator has a height of side wall of 0.2 mm or more and 2.0 mm or less.

8. The metal roofing material according to claim 1, wherein the top plate further comprises a protruding auxiliary indicator extended to be long at a center of the top plate in the eave direction and at an intermediate position of the top plate in the eave-ridge direction.

9. The metal roofing material according to claim 8, wherein the auxiliary indicator has a height of side wall of 0.2 mm or more and 2.0 mm or less.

10. A metal roofing material comprising:

a front substrate made of a metal sheet, the front substrate comprising a body portion formed in a box shape;

a back substrate disposed on a back side of the front substrate so as to cover an opening of the body portion;

a core material filled between the body portion and the back substrate, the metal roofing material being arranged side by side on a roof base together with other metal roofing materials, wherein at least one edge indicator in the form of a protrusion is provided at an edge portion of a top plate of the body portion; and wherein the top plate further comprises a plurality of protruding eave direction indicators arranged along the eave direction of the top plate, each of the eave direction indicators being formed by a plurality of protrusions having an odd number of 3 or more, spaced in the eave direction.

11. The metal roofing material according to claim 10, wherein the eave direction indicator has a height of side wall of 0.2 mm or more and 2.0 mm or less.

12. The metal roofing material according to claim 10, wherein each eave side end edge of the eave direction indicators extends along the eave direction.

13. The metal roofing material according to claim 10, wherein each of the eave direction indicators includes a central indicator formed by a protrusion having an outer shape of a triangle as viewed in the plane, the central indicator having corners that taper toward the outside of the top plate along the eave-ridge direction and being arranged such that a top portion of the corners is placed at a center of the top plate in the eave direction.

14. A metal roofing material comprising:

a front substrate made of a metal sheet, the front substrate comprising a body portion formed in a box shape;

a back substrate disposed on a back side of the front substrate so as to cover an opening of the body portion; and a core material filled between the body portion and the back substrate, the metal roofing material being arranged side by side on a roof base together with other metal roofing materials, wherein the top plate further comprises a plurality of protruding eave direction indicators arranged along the eave direction of the top plate, each of the eave direction indicators being formed by a plurality of protrusions having an odd number of 3 or more, spaced in the eave direction.

15. The metal roofing material according to claim 14, wherein the eave direction indicator has a height of side wall of 0.2 mm or more and 2.0 mm or less.

16. The metal roofing material according to claim 14, wherein each eave side end edge of the eave direction indicators extends along the eave direction.

17. The metal roofing material according to claim 14, wherein each of the eave direction indicators includes a central indicator formed by a protrusion having an outer shape of a triangle as viewed in the plane, the central indicator having corners that taper toward the outside of the top plate along the eave-ridge direction and being arranged such that a top portion of the corners is placed at a center of the top plate in the eave direction.

* * * * *